United States Patent [19]

Nash et al.

[11] 4,271,876

[45] Jun. 9, 1981

[54] METHOD AND APPARATUS FOR FILLING HONEYCOMB PANELS WITH FIBER INSULATION

[76] Inventors: Henry R. Nash, 10659 El Poche, South El Monte, Calif. 91733; Edgar M. Nash, 2613 Bridalpath La., Modesto, Calif. 95350

[21] Appl. No.: 27,251

[22] Filed: Apr. 5, 1979

[51] Int. Cl.[3] ..... B65B 1/24

[52] U.S. Cl. ..... 141/12; 141/67; 141/74; 141/80; 141/125; 141/131; 222/234

[58] Field of Search ..... 141/1, 11, 12, 67, 73, 141/74, 78, 80, 125, 131, 280, 283, 286, 324, 325, 327; 222/234, 254, 371; 406/135, 102

[56] References Cited

U.S. PATENT DOCUMENTS

| | | | |
|---|---|---|---|
| 2,149,461 | 3/1939 | Mundy | 141/78 |
| 3,403,817 | 10/1968 | Morash | 222/371 X |
| 3,964,527 | 6/1976 | Zwart | 141/67 X |
| 4,049,028 | 9/1977 | Harris | 141/286 X |
| 4,106,535 | 8/1978 | Davis | 141/125 X |
| 4,129,338 | 12/1978 | Mudgett | 406/135 |
| 4,153,084 | 5/1979 | Payne | 141/125 |

*Primary Examiner*—Frederick R. Schmidt
*Attorney, Agent, or Firm*—Christie, Parker & Hale

[57] ABSTRACT

A method and apparatus for filling multi-cell or honeycomb cored panels wih fibrous insulation is described. Bales of insulation are reduced to particulate composition and evenly distributed within honeycomb panels.

Insulation reduced to particulate composition is temporarily stored in an insulation feeder. Located within the feeder is a reciprocating grating that disperses the stored insulation at a controlled rate. Below the grating is an insulation conveyor belt that receives the dispersed insulation and transfers it to a point of discharge into a panel to be filled. The panel is conveyed over a vibrator to evenly distribute the insulation contained therein. The panel is also conveyed under reciprocating and rotary brushes that extend into the panel interior for uniformly packing the insulation to achieve an even predetermined insulation density. Flexible scrapers are located between the rotary brushes to scrape the surfaces of the panels clear of any insulation remaining on such surfaces.

26 Claims, 9 Drawing Figures

METHOD AND APPARATUS FOR FILLING HONEYCOMB PANELS WITH FIBER INSULATION

BACKGROUND OF THE INVENTION

1. Field of the Invention

This application relates to an apparatus for filling panels with particulate matter, and more particularly, to an apparatus that evenly distributes and evenly packs the particulate within honeycomb panels.

2. Description of the Prior Art

Methods and apparatus for filling panels with particulate matter such as insulation are known in the prior art. Typically, a panel moves below an insulation dispensing mechanism so that insulation fails onto the panel at a relatively uncontrolled rate. Subsequent to this operation, the insulation is forced into the panels by rotary brushes or by hand to achieve distribution of the particulate within the panels. Structural multi-cell honeycomb cored panels typically used in sandwich building panels that contain cellulose fiber insulation require even insulation densities. The insulation should not be tightly packed since an excess of insulation is wasteful and does not improve the insulating quality while increasing the weight of the sandwich panel. In building applications, the depth of the honeycomb cores varies with the type of sandwich panel used, thus not only the density but the amount of insulation deposited in the honeycomb is critical.

The methods and apparatuses of the prior art devices for filling such honeycomb panels suffer from the inability to evenly distribute and evenly pack the insulation within the panels and thus fail to attain the proper amount and density of insulation deposited within the panels.

Another problem of such devices is the inability of packing the panels with insulation in automated processes. Typically, the panels are filled individually and handled manually, thereby increasing the cost to the consumer as well as increasing the time and expense of the filling operation.

SUMMARY OF THE INVENTION

The present invention contemplates an apparatus for filling panels with particulate matter, the apparatus having means for reducing bales of insulation into a particulate composition, means for evenly distributing the particulate within the panels, means for removing excess particulate from the panel surfaces, and means for compacting the particulate within the panels to obtain a uniform particulate density.

Material, such as loose cellulose insulation, to be distributed in various shaped panels, such as honeycomb panels, is initially fed into an insulation hopper where it is stirred by a rotating insulation agitator to reduce the insulation from its bulky, tightly packed state to a looser particulate composition. The particulate is then drawn from the bottom of the insulation hopper by a blower having a plurality of blower blades that serve to separate the particulate into yet smaller particles. The particulate is blown through appropriate ducts into an insulation feeder. A variable volume air bypass in the blower ducts regulates the amount of particulate drawn from the insulation hopper. Automatic control of the depth of the insulation feeder is provided by the variable volume air bypass. The blower ducts discharge the particulate into the upper portion of the insulation feeder.

A baffle and a plurality of spaced apart and orthogonally positioned splitters evenly distribute the particulate falling through the insulation feeder onto a variable speed reciprocating grating. The reciprocating grating serves to transfer therethrough the particulate at a rate controlled by the speed of reciprocation of the grating. Located immediately below the grating is an endless, reversing insulation feeder belt that receives the particulate transferred through the grating. The particulate is carried by the insulation feeder belt to a station which is at the point of reversal of direction of the belt, the particulate falling at such point into a panel positioned therebelow.

The rate of reciprocation of the grating as well as the speed of the insulation feeder belt establish the rate at which insulation is fed into the panels. To fill thicker panels, for example, the speed of reciprocation of the grating may be increased, and the speed of the insulation feeder belt may be increased so that the rate of depositing insulation within the panels is increased.

Forward of the point of discharge of particulate from the insulation feeder belt is a variable amplitude panel vibrator. The vibrator which is in contact with a panel conveyor belt vibrates the belt as well as a panel carried thereon as it passes over the vibrator so as to more evenly distribute the particulate within the panels. Additionally, vibrating the honeycomb panels will dislodge any insulation landing on the edges of the honeycomb, thus preventing its buildup.

Forward of the vertical amplitude panel vibrator are reciprocating brushes, rotary brushes and flexible scrapers.

Although the insulation particulate fills the voids in the honeycomb core, the density of the insulation may be low such that the required amount of insulation may form a blanket that is thicker than the depth of the honeycomb. The reciprocating brushes and rotary brushes extend into the panels and serve to compact the the insulation below the top of the honeycomb core while establishing the proper insulation density. insulation density.

The flexible scrapers remove any insulation remaining along the upper edges of the panel such that the panels exiting the apparatus are free of any residue collected thereon.

DETAILED DESCRIPTION

Figure 1:
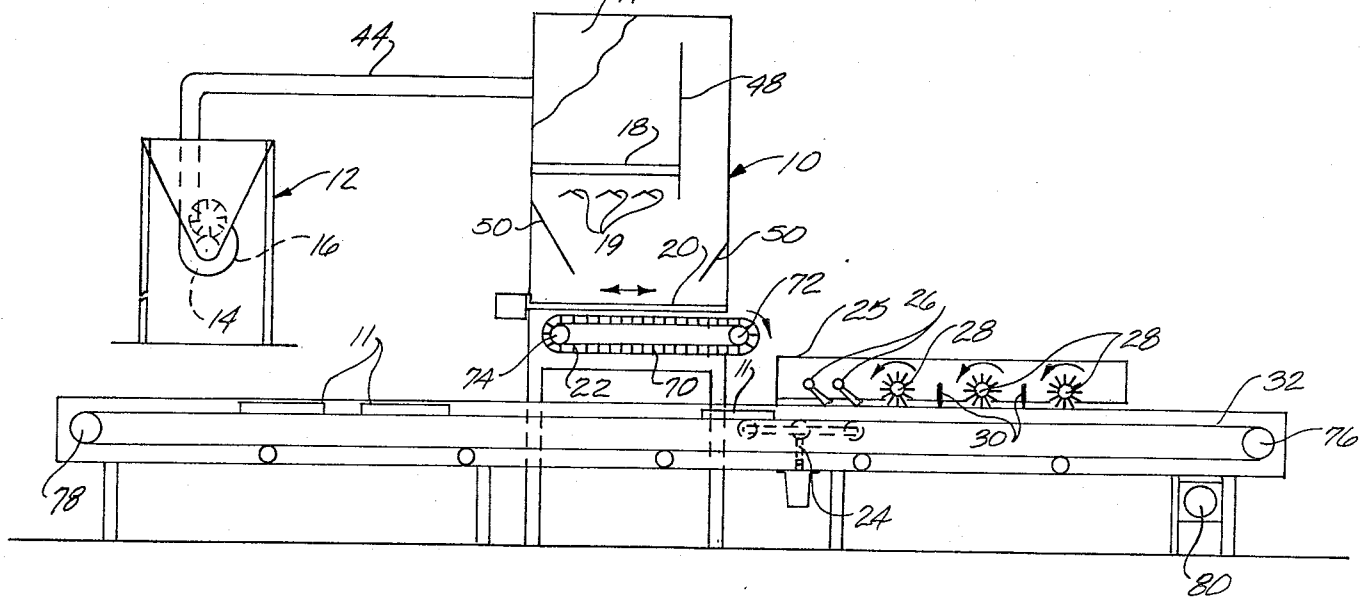
FIG. 1 is a schematic side elevation view showing an apparatus for filling honeycomb panels with fiber insulation and taken along plane 1—1 of FIG. 4.

Referring to FIG. 1, there is shown an apparatus 10 for filling panels 11 with particulate matter, and in particular, the filling of multi-cell or honeycomb cored panels such as honeycombs with cellulose fibrous insulation material. The apparatus 10 includes an insulation hopper 12, an insulation reducer 14, an insulation blower 16, an insulation feeder chamber 17, splitters 18 and 19, a reciprocating grating 20, an insulation feeding belt 22, a panel vibrator 24, reciprocating brushes 26, rotating brushes 28, flexible scrapers 30, and panel conveyor belt 32. Multi-cell panels typically have a plurality of partitions that divide the panel into a plurality of individual cavities. The orientation of the cavities and the honey comb is such that they form vertical passages when the panels are placed on belt 32.

In a typical application, a bale of insulation is placed within hopper 12. An insulation reducer 14 reduces the bales of insulation to particulate size, said particulate being further reduced and blown by insulation blower 16 into insulation feeder chamber 17. Splitters 18, arranged horizontally and crosswise to splitters 19, evenly disperse the particulate blown into insulation feeder chamber 17 onto reciprocating grating 20. The amplitude and speed of the reciprocation of reciprocating grating 20 controls the passage of insulation therethrough.

The insulation material passed through grating 20 is deposited on insulation feeder belt 22 which travels at a controlled rate of speed. The feeder belt 22 is essentially below the grating 20, and at the point of belt direction reversal, the insulation carried by the belt falls therefrom in a gravity feed manner. The gravity fed insulation falls into panels 11, passing below insulation feeder belt 22. Passing over belt vibrator 24, the panel 11 is vibrated so that the insulation particulate discharged by the insulation feeder belt 22 will be distributed within the panels 11 in a uniform manner.

Located forward of insulation feeder belt 22 and above the panels 11 are reciprocating brushes 26 that move in a direction transverse to the forward direction of travel of the panels which is from left to right when referring to FIG. 1. The reciprocating brushes 26 extend to the upper edges of panel 11 thus removing from the honeycomb and panel edges any insulation material that has accumulated on such edges as a result of the gravity feed process. Forward (in the direction of travel of the panels) of the reciprocating brushes 26 are located rotating brushes 28 which have brush ends that extend into the interior of the panels. The depth of the extension of the brushes into the panels is controllable so that the insulation within the panels may be compacted to a desired density. Between the rotating brushes 28 are located flexible scrapers 30 that contact the entire upper surface of the panels 11, scraping therefrom any insulation not removed by the reciprocating brushes 26 or deposited by the rotating brushes 28 as the panels 11 travel thereunder.

Figure 2:
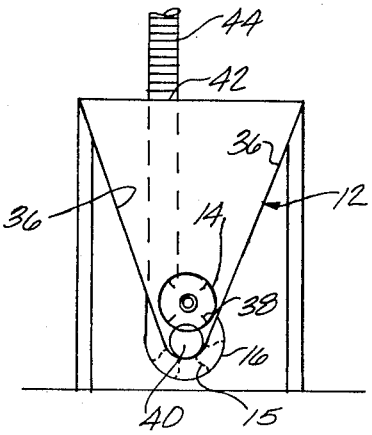
FIG. 2 is an expanded schematic side elevation view of the insulation hopper of the apparatus of FIG. 1 and taken along plane 2—2 of FIG. 4.

Referring now to FIG. 2, there is shown a detailed view of insulation hopper 12. Insulation hopper 12 has downwardly converging inclined walls 36. At the bottom of hopper 12 is located rotating insulation agitator 14 having insulation reducing arms 38. Below the rotating insulation agitator 14 is insulation blower 16 having an inlet 40 and an outlet 42. Connected between the outlet 42 and the insulation feeder chamber 17 is conduit 44. The rotating reducing arms 38 serve to pulverize the insulation bales placed into insulation hopper 12 and feed the insulation toward the insulation blower inlet 40. The resulting insulation particulate is drawn into blower intake 40 and is blown through conduit 44 into the insulation feeder chamber 17. Further reduction of the insulation to yet a smaller size is accomplished by means of blower blades 15 located within inlet 40. In the preferred embodiment, a blower 16 is located at each end of insulation hopper 12. Each blower has a connecting conduit 44 between the blower outlet 42 and insulation feeder chamber 17.

Figure 3:
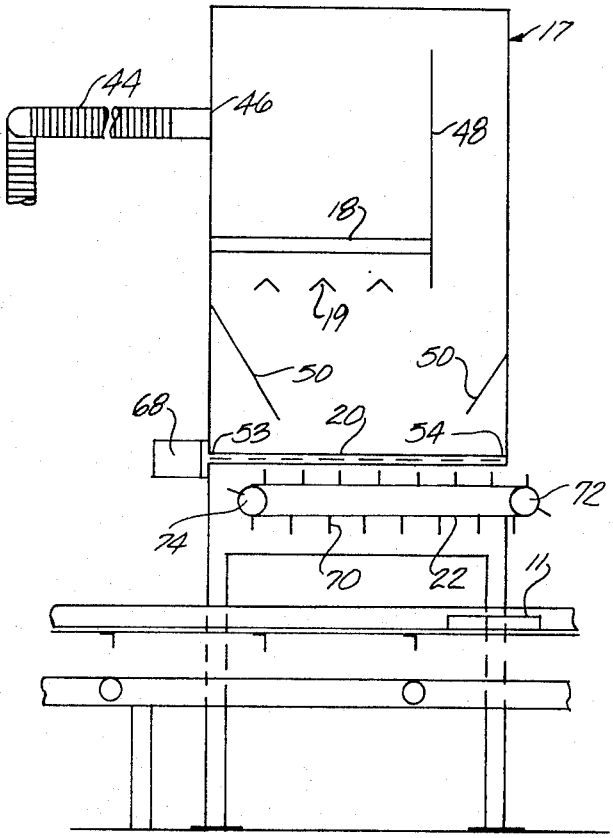
FIG. 3 is an expanded schematic side view of the insulation feeder of the apparatus of FIG. 1 and taken along plane 1—1 of FIG. 4.
Figure 4:
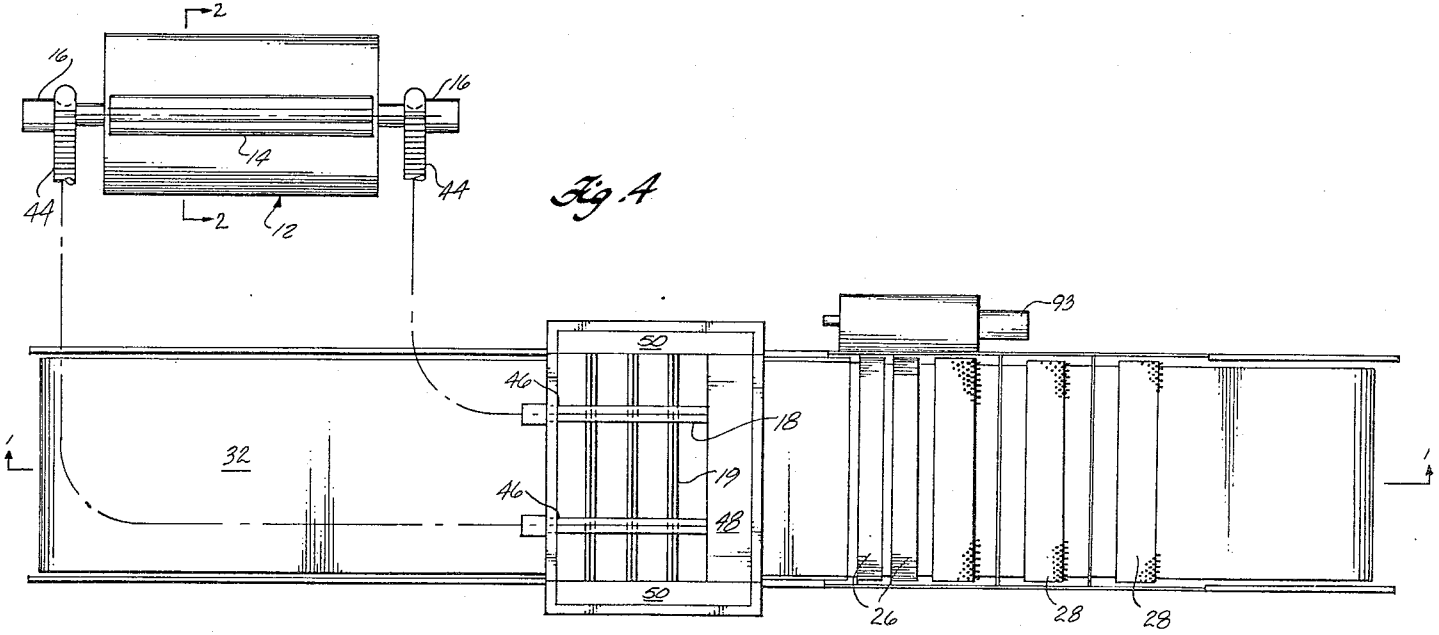
FIG. 4 is a schematic top plan view of the insulation hopper and insulation feeder (top removed) of the apparatus of FIG. 1.

Referring now to FIG. 3, there is shown a detailed side view of the insulation feeder chamber 17, and referring to FIG. 4 there is shown the insulation hopper 12 coupled to to the insulation feeder chamber 17. Insulation from conduit 44 entering at inlets 46 is temporarily stored in insulation feeder chamber 17. Upon entrance into insulation feeder chamber 17, the particulate impacts baffle 48 from which it rebounds and falls in a gravity feed manner through a plurality of spaced apart splitters 18 and 19 certain of which are oriented above and crosswise to the remainder. The splitters 18 and 19 are generally V-shaped having their apex oriented upwards in a direction to first contact the particulate entering the insulation feeder chamber 17. The splitters 18 and 19 serve to evenly distribute the particulate in the insulation feeder chamber 17 by dispersing the particulate that passes therebetween in an even and uniform manner. Baffles 50, located at the lower portion of insulation feeder chamber 17 and below the splitters 18 and 19, serve to guide the falling particulate onto the central portion of reciprocating grating 20. Additionally, baffles 50 prevent accumulation of the particulate in the corners 53 and 54 of insulation feeder chamber 17.

Figure 5:
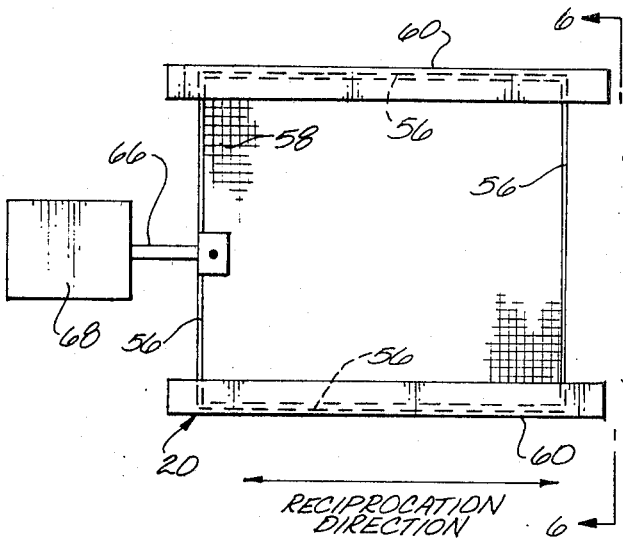
FIG. 5 is a detailed schematic top view of the reciprocating grating of the apparatus of FIG. 1.
Figure 6:
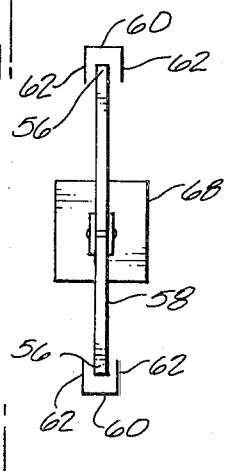
FIG. 6 is a detailed schematic end view of the reciprocating grating and taken along plane 6—6 of FIG. 5.

Referring now to FIGS. 5 and 6, there is shown a top and side view respectively of reciprocating grating 20. Reciprocating grating 20 has panel edges 56 that enclose within its perimeter a wire mesh screen 58. Mesh dimensions for screen 58 are selected based upon the desired particulate size such that the mesh size is marginally larger than the size of particulate desired to pass therethrough. As an example in the preferred embodiment for a particle length of about ¾ inch and a thickness of about 5 mils, the mesh dimension may vary from about ½ inch by ½ inch to 1 inch by 1 inch. Panel edges 56 are slidably maintained within U-shaped guide channels 60. The guide cannels 60 have arms 62 that partially surround panel edges 56, thus restricting the motion of panel edges 56, except in the direction of reciprocation within channels 60. The direction of reciprocation is essentially parallel to the direction of an insulation feeder conveyor belt 22 that passes below the reciprocating grating 20.

Coupled to one panel edge 56 by means of connecting rod 66 is a vibrator 68. In the preferred embodiment, the vibrator 68 is a variable speed, variable displacement electromagnetic device such as Syntron Model V2 Vibrator. Both the speed and displacement of the reciprocation of grating 20 are controllable so that the rate of particulate passing through the grating 20 is controllable. Increasing the speed and the displacement of the grating 20 causes the particulate to pass therethrough at a rate faster than that which would occur for slower reciprocation speeds and displacements.

Below the reciprocating grating 20 is located insulation feeder belt 22 (see FIG. 3). Insulation feeder belt 22 is an endless conveyor belt that is secured between end rollers 72 and 74. The insulation feeder belt 22 has raised separators 70. The raised separators 70 serve to confine the particulate falling from the reciprocating grating 20 in uniform amounts on the insulation feeder belt 22. The insulation feeder belt 22 is driven by a variable speed drive (not shown) so that the rate of discharge of particulate from the belt is controllable.

In typical applications, the particulate falling from the grating 20 onto belt 22 is conveyed in a direction towards end roller 72. At end roller 72, the direction of the conveyor reverses, and the insulation contained within the regions between the raised separators 70 falls in a gravity feed manner onto and into the panels 11 moving directly below the point of discharge of the particulate.

Figure 7:
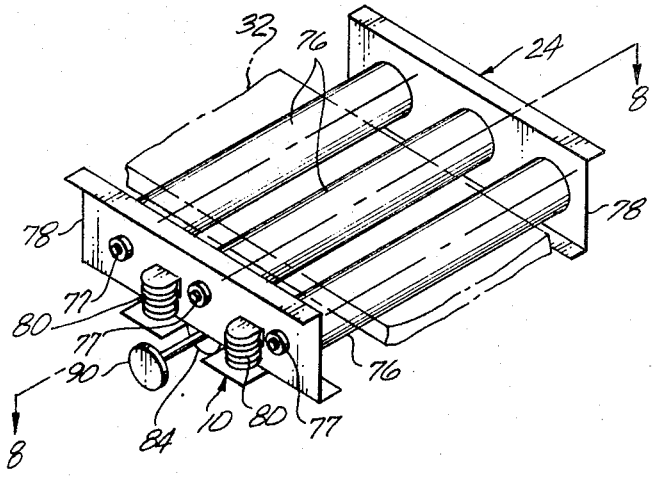
FIG. 7 is an exploded perspective view of the vibrator of the apparatus of FIG. 1.
Figure 8:
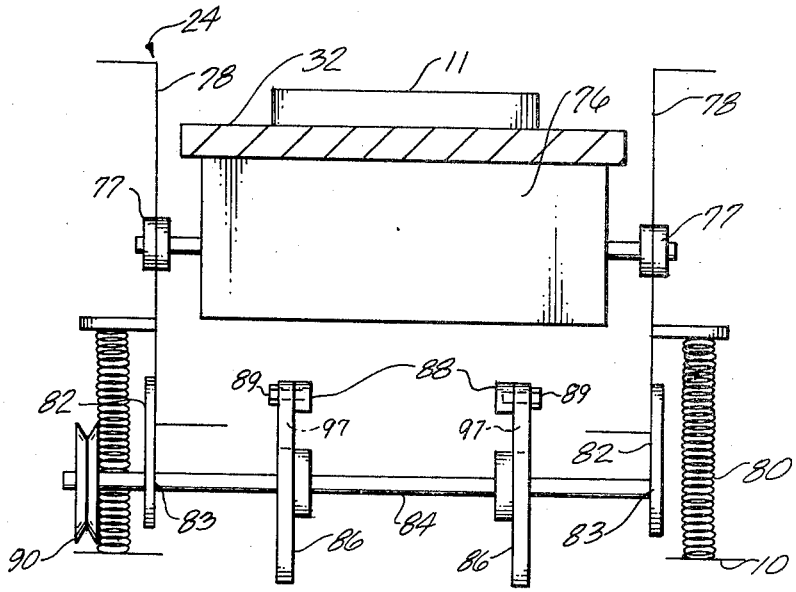
FIG. 8 is a schematic side view of the vibrator of the apparatus of FIG. 1 and taken along plane 8—8 of FIG. 7.

Referring now to FIG. 7 and FIG. 8, there is shown in perspective view and side view, respectively, a panel vibrator 24. The vibrator 24 is located forward of the point of discharge of the particulate from the insulation feeder belt 22. The vibrator has a plurality of rollers 76, rotatably mounted by means of rotary bearings 77 between support end brackets 78. The rollers are mounted transverse to the direction of travel of the conveyor belt 32 that moves thereon. Support end brackets 78 are flexibly mounted to the apparatus frame 10 by means of springs 80 such that the brackets 78 are vibratable yet constrained with respect to the frame 10. Rotatably mounted between bracket extension pieces 82 by means of rotary bearings 83 is shaft 84. Located on shaft 84 and secured thereto between extension pieces 82, are circular mounting plates 86. Off centered weights 88 are movable radially within the slots 97 that are located in circular mounting plates 86. The weights 88 are secured to the mounting plate 86 by means of locking bolts 89. Mounted to one end of shaft 84 is V-belt pulley 90. The V-belt pulley 90 may be driven by any conventional variable speed drive, such as a one-half horsepower 250 to 1000 rpm motor.

Upon actuation of the variable speed motor, shaft 84 rotates about its axis of rotation. Off-centered weights 88 provide an adjustable rotational imbalance such that support ends 78 vibrate in an oscillatory manner constrained by the springs 80. Thus, as a panel carrying conveyor belt 32 moves over rollers 76, the conveyor belt 32, as well as the panels 11 carried thereon, are vibrated in an oscillatory manner such that insulation particulate contained within the panels is vibrated to cause an even distribution of the particulate within the panel cores.

Figure 9:
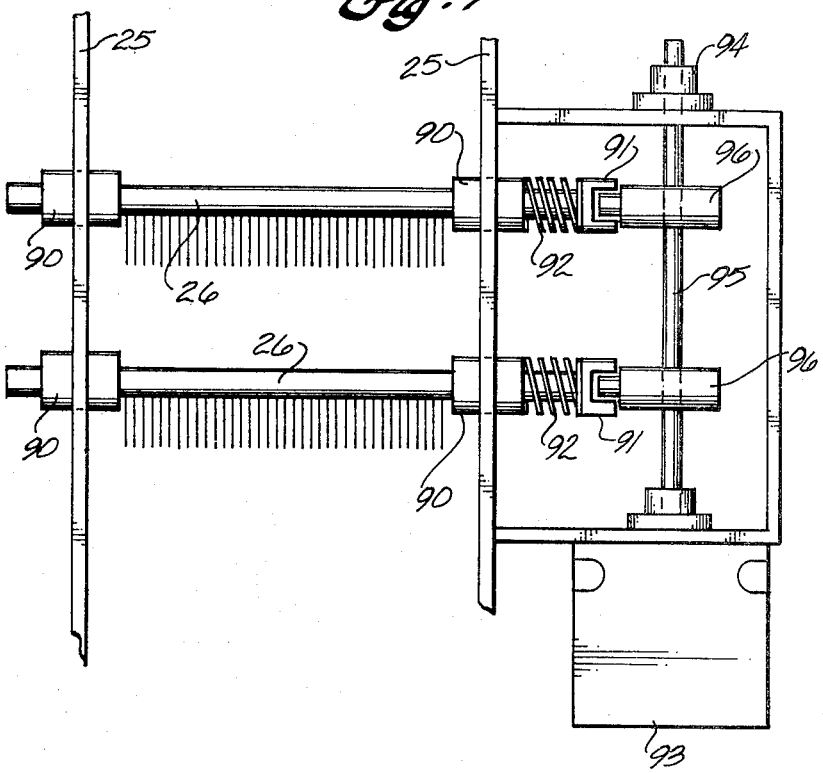
FIG. 9 is a detailed schematic top view of the reciprocating brush drive of the apparatus of FIG. 1.

Referring to FIG. 9, there is shown in detail a top view of the reciprocating brushes 26. Mounted in brush assembly frame 25 and located above the forward half of the panel vibrator 24 (see FIG. 1) and in contact with the panels passing thereunder are reciprocating brushes 26. Reciprocating brushes 26 extend to the top and across panels 11 and reciprocate in a back-and-forth manner transverse to the direction of travel of belt 32 such that insulation particulate matter remaining on the edges of the honeycomb partition is brushed away from such edges into the interior of the panels 11. Additionally, particulate contained within the panel is evenly distributed due to the reciprocating motion of the brushes. Such reciprocation of brushes 26 is particularly advantageous when the interior of the panels 11 is formed of honeycomb-type structures.

Reciprocating brushes 26 are slidably mounted within slide bearings 90 that are located in the side portions of brush assembly 25. Connected to one end of each brush 26 is a U-shaped cam receiver 91. Between slide bearings 90 and cam receiver 91 is mounted a pre-loaded coil spring 92. Spring 92 serves to urge the brushes 26 in a direction towards offset cams 96 and transverse to the direction of travel of the conveyor belt 32. Mounted on the brush assembly frame 25 is variable speed drive 93. Coupled between the variable speed drive 93 and end mounting bearing 94 is rotatable shaft 95. Mounted on shaft 95 and operatively engaging the corresponding cam receiver 91 are offset cams 96. The cams 96 move the brushes 26 in a direction opposite to that urged by springs 92 and as the cams rotate in a direction to first engage cam receiver 91, the brushes are moved in a direction opposite to that urged by springs 92. Thus as the cams 96 alternately move into and out of engagement with the cam receiver 91, the brushes 26 are reciprocated across the panels.

Rotatably mounted in brush assembly frame 25 forward of reciprocating brushes 26 are rotating brushes 28 (see FIG. 1). Rotating brushes 28 are also vertically adjustable with respect to the panels traveling thereunder such that the depth at which the rotating brushes extend into the panels is controllable. Any one of a number of conventional means for adjustably extending the rotating brushes 26 may be used. Rotating brushes 28 serve as final packing of the particulate within the panel.

The rotational speed of the rotating brushes 28 is controlled by the same drive (not shown) that actuates conveyor belt 32 so that the tangential velocity of the brushes 28 measured at the brush ends is equal to the linear velocity of the panel traveling below the brushes 28. The sameness of the speeds just described insures that the rotary brushes 28 perform a pushing down, packing function, rather than a "sweeping away" function. The control of the rotational velocity of rotating brushes 28 by the variable speed drive 80 that controls conveyor belt 32 insures that for all speeds of the conveyor belt 32, the tangential velocity of the rotating brushes 28 will equal the linear velocity of the belt and, therefore, will equal the linear velocity of the panels traveling under the rotating brush.

Extending from the brush assembly frame 25 is a plurality of flexible scrapers 30. The flexible scrapers, preferably formed from a flexible material such as rubber, are located between the rotating brushes 28 and extend laterally across conveyor belt 32. The flexible scrapers 30 contact the upper surface of the panels so that any particulate not removed by reciprocating brushes 26, or disturbed by rotating brushes 28, is scraped away from such panel upper surface. Thus, the panels 11 exiting the apparatus frame 10 are characterized as having clean edges free of insulation particulate while having a uniform density of the particulate within the panels.

Circulating around end rollers 76 and 78 is an endless conveyor belt 32. Conveyor belt 32 is driven through appropriate gearing (not shown) by variable speed drive 80. Variable speed drive 80 additionally actuates rotating brushes 28, as previously described, so as to maintain the rotary velocity of the rotating brushes consistent with the velocity of the conveyor belt 32.

While the basic principle of the invention has been herein illustrated along with one embodiment, it will be appreciated by those skilled in the art that variations in the disclosed arrangement both as to its details and as to the organization of such details may be made without departing from the spirit and scope thereof. For example, the detailed description has focused on the apparatus and method as applied to filling panels such as honeycomb-type panels with insulation material. However, the apparatus and method are equally applicable for filling panels with any particulate such as fire retardant material and the like.

Accordingly, it is intended that the foregoing disclosure and the showings made in the drawings will be considered only as illustrative of the principle of the invention and not construed in a limiting sense.

What is claimed is:

1. An apparatus for filling panels with particulate matter comprising:

means for reducing fibrous material into a particulate composition; p1 a particulate feeder;

means for transferring the particulate from the reducing means to the particulate feeder, the particulate feeder having a particulate feeder chamber for temporarily storing the particulate transferred from the reducing means;

a reciprocating grating located within the particulate feeder chamber for uniformly passing therethrough in response to reciprocation of said grating the particulate from the particulate feeder chamber, the grating having a plurality of openings, each opening being sized marginally larger than the size of the particulate;

means, coupled to the grating, for controllably reciprocating said grating, the grating passing uniformly therethrough particulate at a rate corresponding to the rate of reciprocation of the reciprocating means;

an endless direction reversing particulate feeder belt located below the grating, said feeder belt adapted to receive the particulate passed through the grating and to discharge, at a point of belt direction reversal, said particulate in a gravity feed manner;

the belt rotating about guide roller means, said belt located below and adapted to receive particulate passing through the grating, the belt having a plurality of spaced apart ribs extending above the surface of the belt to maintain the particulate upon the belt, the particulate dropping onto said panel from the belt in a gravity feed manner at a point of belt direction reversal;

means for removing excess particulate from the panels surfaces; and means for compacting the particulate within the panels to obtain a uniform density thereof.

2. The apparatus according to claim 1 wherein the means for reducing the bales of fibrous material further comprises:

hopper means to receive bales of fibrous material; and a fibrous material agitator located within the hopper to reduce the fibrous material to particulate composition.

3. The apparatus according to claim 2 wherein the means for transferring includes blower means for blowing the particulate from the hopper means into the particulate feeder.

4. The apparatus of claim 3 wherein the blower means includes means for pulverizing the particulate composition.

5. The apparatus according to claim 1 further comprising means for evenly distributing the particulate in the particulate feeder chamber.

6. The apparatus according to claim 5 wherein the means for evenly distributing the particulate in the particulate feeder chamber comprises a plurality of spaced apart splitters certain of which are oriented above and crosswise to the remainder, the splitters shaped to distribute the particulate from the reducing means onto the reciprocating grating means.

7. The apparatus according to claim 6 wherein the splitters are generally V-shaped having the apex oriented upward in a direction to first contact the particulate entering the particulate feeder chamber.

8. The apparatus according to claim 1 wherein the belt is driven by a controllable variable speed drive means to control the rate of particulate dropping from the belt.

9. The apparatus according to claim 1 further including vibrator means for vibrating the panels as the panels are being filled.

10. The apparatus according to claim 9 wherein the vibrator means further comprises:

a conveyor belt vibrator frame;

a plurality of spaced apart rollers rotatably mounted to the frame, said rollers contacting the conveyor belt crosswise to the direction of movement of said conveyor belt; and a controllable variable amplitude vibrator coupled to the vibrator frame such that panels on the conveyor belt, and passing over the vibrator, will be vibrated so that particulate will be uniformly distributed within the panel.

11. The apparatus according to claim 1 wherein the means for removing excess particulate from the panel surface includes reciprocating brush means located above the panels such that particulate not deposited within the panel is brushed from the panel surface.

12. The apparatus according to claim 1 wherein the means for compacting the particulate includes a plurality of spaced apart rotary brushes, the brush ends defining the outer circumference of the brush, said brush ends extending partially within the panels passing therebelow, thereby uniformly compressing the particulate within the panels.

13. The apparatus according to claim 12 including means for vertically adjusting the rotary brushes for adjusting the depth of which the brush ends extend within the panels.

14. The apparatus according to claim 1 wherein the means for removing excess particulate from the panel surface further includes flexible scraper means disposed above the panels and adapted for contacting the surface of the panels such that particulate accumulating on the surface of the panel is removed as the panel passes thereunder.

15. The apparatus according to claim 1 further comprising conveyor means for conveying the panels to be filled with particulate past the particulate feeder such that gravity fed particulate is uniformly deposited into the panels, said conveyor means conveying the panels past the removing means and the compacting means.

16. The apparatus according to claim 15 wherein the conveyor means comprises:

a conveyor frame having a first end at which panels to be filled with particulate enter the apparatus and a second end at which panels filled with particulate exit the apparatus;

conveyor belt guide rollers rotatably secured at each end;

an endless conveyor belt secured onto the guide rollers; and a controllable variable speed rotary drive coupled to the guide rollers to control the speed of the belt.

17. The apparatus according to claim 16 comprising a plurality of spaced apart rotary brushes, the brush ends defining the outer circumference of the brush, said brush ends extending partially within the panels passing therebelow, thereby uniformly compressing the particulate within the panels, means for rotating the brushes wherein the rotary speed of the rotary brushes is synchronized to that of the conveyor belt such that the rotary brushes solely and uniformly compact the insulation within the panel passing thereunder.

18. A method of filling panels with fibrous particulate matter comprising the steps of:

reducing fibrous material into a particulate composition;

transferring the reduced particulate to a particulate feeder, the particulate feeder having a particulate feeder chamber for temporarily storing therein the transferred particulate;

reciprocating a grating below the particulate feeder chamber for uniformly passing therethrough, in response to the reciprocation of said grating, the particulate from the particulate feeder chamber;

discharging onto an endless direction reversing particulate feeder belt located below the grating, the particulate passed through the grating;

discharging, at a point of belt direction reversal, said particulate into the panels in a gravity feed manner;

removing excess particulate from the panel surfaces; and compacting the particulate within the panels to obtain a uniform density thereof.

19. The method of claim 18 further comprising the step of adjusting the rate of reciprocation of the reciprocating grating for adjusting the rate of passage of particulate therethrough.

20. The method of claim 18 further comprising the step of vibrating the panels filled with insulation to evenly distribute the particulate within the panels.

21. The method of claim 18 wherein the step of removing excess particulate from the panel surface comprises the step of brushing the particulate not deposited within the panel from the panel surface.

22. The method of claim 18 wherein the step removing excess particlate from the panel surface further comprises the step of scraping away particulate accumulating on the surface of the panel.

23. The method of claim 18 wherein the step of compacting further comprises adjusting the amount of compaction to thereby adjust the density of the particulate within the panels.

24. An apparatus for filling panels with particulate matter comprising:

means for reducing fibrous material into a particulate composition;

a particulate feeder chamber for temporarily storing the particulate;

conveyor means located below the particulate feeder chamber for conveying the panels to be filled with particulate through the apparatus;

means for evenly distributing the particulate in the panels comprising an endless direction reversing particulate feeder belt means located between the particulate feeder chamber and the conveyor means, said belt means adapted to receive the particulate from the particulate feeder chamber and for gravitationally discharging such particulate into the panels in a uniform manner at a point of belt direction reversal;

a reciprocating grating located within the particulate feeder chamber for uniformly passing therethrough in response to reciprocation of said grating the particulate from the particulate feeder chamber, the grating having a plurality of openings, each opening sized marginally larger than the size of the particulate;

means, coupled to the grating, for controllably reciprocating said grating, the grating passing uniformly therethrough particulate at a rate corresponding to the rate of reciprocation of the reciprocating means;

means for removing excess particulate from the panel surfaces; and means for compacting the particulate within the panels to obtain a uniform density thereof.

25. The apparatus according to claim 24 further comprising oscillatory vibrator means for vibrating the panels in an oscillatory manner as the panels are being filled.

26. The apparatus according to claim 24 wherein the conveyor means comprises a conveyor belt for conveying the panels below said particulate feeder chamber, the panels receiving thereby the discharged particulate, the vibrator means coupled to the conveyor belt for vibrating the conveyor belt and the panels thereon for providing uniform density of particulate within the panels.

* * * * *

UNITED STATES PATENT AND TRADEMARK OFFICE

CERTIFICATE OF CORRECTION

PATENT NO. : 4,271,876

DATED : June 9, 1981

INVENTOR(S) : Henry R. Nash and Edgar M. Nash

It is certified that error appears in the above—identified patent and that said Letters Patent is hereby corrected as shown below:

In the specification, Column 1, Line 16, "fails" should read -- falls --. Column 4, Line 53, "cannels" should read -- channels --. In the claims, Column 7, Line 22, Claim 1, delete "pl" before "a particulate feeder"; Line 22, "a particulate feeder" should start a new paragraph.

Signed and Sealed this

*Sixteenth* Day of *February 1982*

[SEAL]

*Attest:*

GERALD J. MOSSINGHOFF

*Attesting Officer*

*Commissioner of Patents and Trademarks*